US011761727B2

(12) United States Patent
Liu

(10) Patent No.: US 11,761,727 B2
(45) Date of Patent: Sep. 19, 2023

(54) ARROW FEEDING DEVICE FOR CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 63 days.

(21) Appl. No.: 17/560,128

(22) Filed: Dec. 22, 2021

(65) Prior Publication Data

US 2022/0113107 A1 Apr. 14, 2022

Related U.S. Application Data

(63) Continuation-in-part of application No. 16/936,432, filed on Jul. 23, 2020, now abandoned.

(51) Int. Cl.
*F41B 5/12* (2006.01)

(52) U.S. Cl.
CPC ..... *F41B 5/126* (2013.01)

(58) Field of Classification Search
CPC ..... F41B 5/126
USPC ..... 124/25.5, 25.7, 45
See application file for complete search history.

(56) References Cited

U.S. PATENT DOCUMENTS 918,444 A * 4/1909 Griffith ..... F41B 5/126 124/52
2,516,341 A * 7/1950 Raffeis ..... F41B 5/126 124/35.1
3,739,765 A * 6/1973 Moore ..... F41B 5/12 124/44.6
3,968,783 A * 7/1976 Pfotenhauer ..... F41B 5/126 124/40
5,544,641 A * 8/1996 Jenn ..... F41G 1/467 124/52
6,868,845 B1 * 3/2005 Moore ..... F41B 5/10 124/25
10,495,403 B1 * 12/2019 Liu ..... F41B 5/143
10,663,249 B1 * 5/2020 Liu ..... F41B 5/126
2011/0226226 A1 * 9/2011 Isabelle ..... F41B 11/52 124/80
2011/0271941 A1 * 11/2011 Meggs ..... F41B 11/641 124/31
2015/0027426 A1 * 1/2015 Isabelle ..... F41B 11/52 124/80
2020/0300575 A1 * 9/2020 Zuo ..... A63H 33/18
2022/0026171 A1 * 1/2022 Liu ..... F41B 5/126

* cited by examiner

*Primary Examiner* — John E Simms, Jr.

(57) ABSTRACT

A crossbow includes a magazine mounted to the top of the crossbow and the magazine includes a storage space defined through the top and the bottom top of the magazine, and the storage space communicates with the flight rail of the crossbow. Multiple arrows are loaded in the storage space. The magazine includes two first engaging members which are removably engaged with two second engaging members formed on the top of the crossbow. Two protrusion respectively extend inward from two inside walls of the storage space to restrict and guide this arrows in the storage space. A retainer has a first end thereof connected to the magazine and a resilient member is located in the storage space and biases between the retainer and the inside of the storage space such that the retainer normally pressing the arrows in the storage space.

9 Claims, 11 Drawing Sheets

ARROW FEEDING DEVICE FOR CROSSBOW

FIELD OF THE INVENTION

This is a Continuation-In-Part patent application of applicant's former patent application with application Ser. No. 16/936,432.

BACKGROUND OF THE INVENTION

Descriptions of Related Art

The conventional way to use the crossbow is to load an arrow into the flight rail on the barrel of the crossbow, and then cocking the arrow to pull the string. The user hold the crossbow and aim the target, when pulling the trigger, the arrow is shot by the recovery force of the string. Then the user has to lower the crossbow and picks another arrow to load the arrow into the crossbow as the steps mentioned previously. However, these repeated steps break the temple of the shooters, and takes a lot of time to aim again.

U.S. Pat. No. 2,516,341 to Raffeis and U.S. Patent Application No. 2015/0144117 to Khoshnood respectively discloses a crossbow, and none of the two inventions teaches a magazine that allows the users to aim the target and shoot continuously. U.S. Pat. No. 6,868,845 to Mooore discloses a magazine that is released from and connected to the crossbow from the underside of the crossbow. This means that the crossbow has to have a different structure from the existed crossbows, because the existed crossbows are loaded from the top of the body of the crossbow.

The present invention intends to provide an arrow feeding device for a crossbow to feed the arrows one by one without repeatedly loading the arrows to the crossbow. The present invention effectively eliminate shortcomings mentioned above.

SUMMARY OF THE INVENTION

The present invention relates to a crossbow with an arrow feeding device, and comprises a magazine mounted to the top of the crossbow and located above a flight rail of the crossbow. A storage space is defined through the magazine from the top to the bottom of the magazine so that multiple arrows are loaded in the storage space. Two first engaging members are formed to the bottom of the magazine. The storage space is located between the two first engaging members. Two second engaging members are formed to the top of the crossbow. The flight rail is located between the two second engaging members. Two protrusion respectively extend inward from two inside walls of the storage space and contact the arrows in the storage space. When the magazine is mounted to the top of the crossbow, the first engaging member are engaged with the second engaging members. A retainer has the first end thereof located in the storage space and connected to the magazine. A bolt extends through the magazine and extends through the retainer from outside of the magazine to connect the retainer to the magazine. A resilient member is located in the storage space and biased between the retainer and the inside of the storage space. The resilient member provides a force to make the retainer resiliently and normally press the arrows in the storage space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
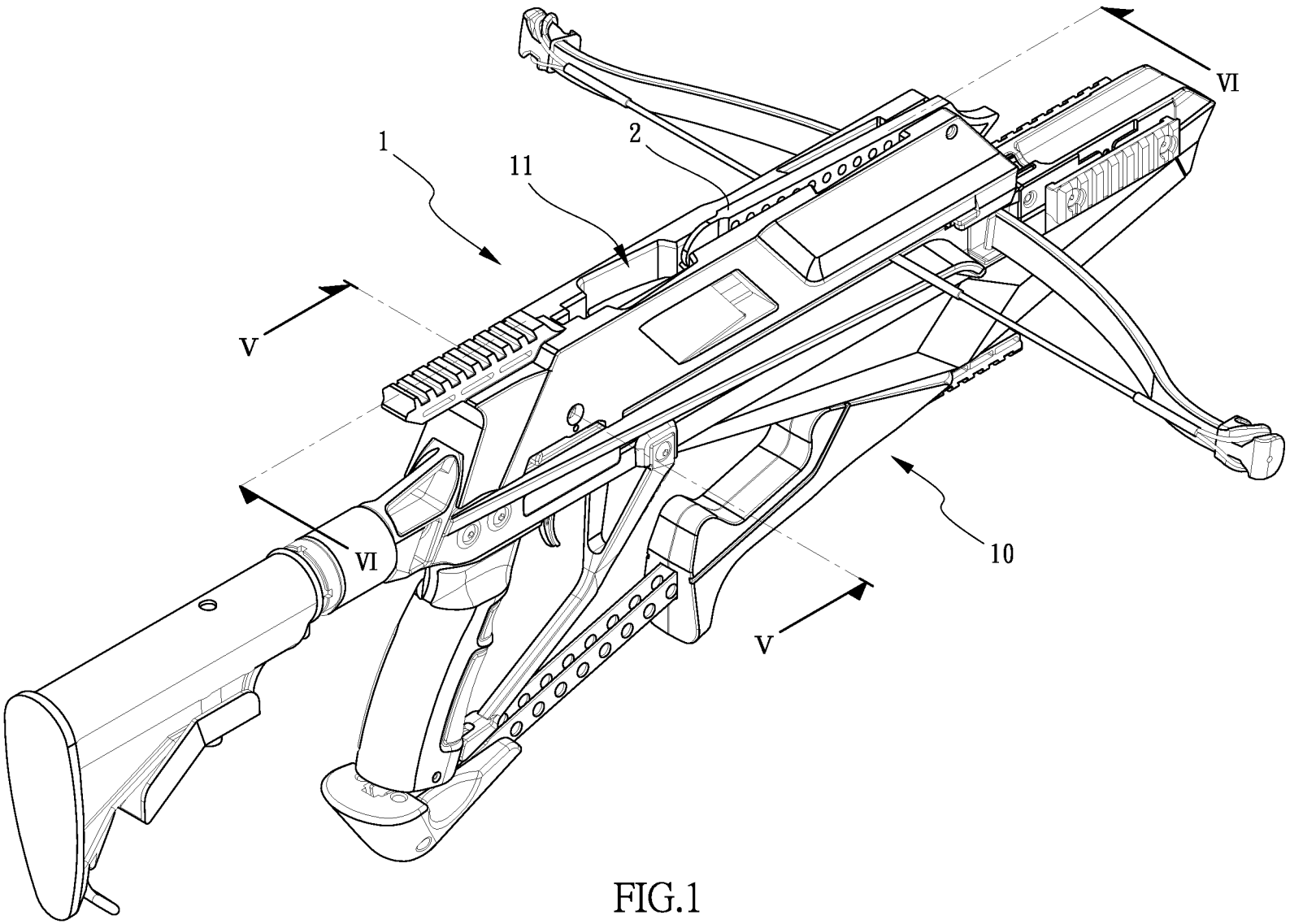
FIG. 1 is a perspective view to show that the magazine is mounted to the top of the crossbow.
Figure 2:
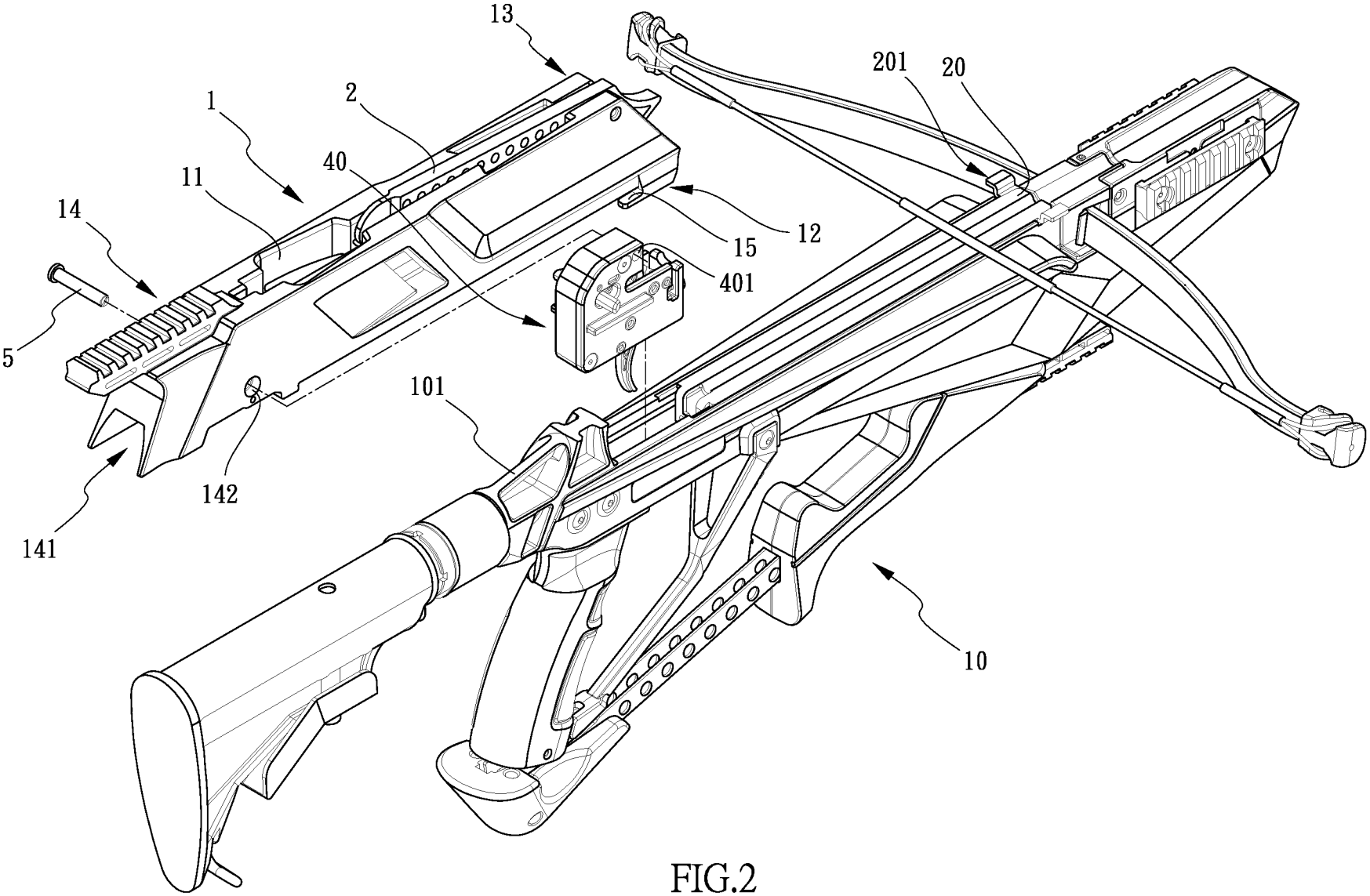
FIG. 2 is an exploded view of the crossbow, the magazine and the trigger unit.

Referring to FIGS. 1 to 10, the crossbow with an arrow feeding device of the present invention comprises a magazine 1 mounted to the top of the crossbow 10 and located above a flight rail 20 of the crossbow 10. A storage space 11 is defined through the magazine 1 from the top of the magazine 1 to the bottom of the magazine 1 so that multiple arrows 30 are loaded in the storage space 11. The arrows 30 enter into the flight rail 20 one by one. Two first engaging members 12 are formed to the bottom of the magazine 1, wherein the storage space 11 is located between the two first engaging members 12. Two second engaging members 201 are formed to the top of the crossbow 10, wherein the flight rail 20 is located between the two second engaging members 201. A retainer 2 has the first end thereof located in the storage space 11 and connected to the magazine 1. A bolt 3 extends through the magazine 1 and extends through the retainer 2 from outside of the magazine 1 to connect the retainer 2 to the magazine 1. A resilient member 4 is located in the storage space 11 and biased between the retainer 2 and the inside of the storage space 11. The resilient member 4 provides a force to make the retainer resiliently and normally press the arrows 30 in the storage space 11. Two protrusion 17 respectively extend inward from two inside walls of the storage space 11 and contact the arrows 30 in the storage space 11. When the magazine 1 is mounted to the top of the crossbow 10, the first engaging member 12 are engaged with the second engaging members 201.

The retainer 2 normally and resiliently presses the arrows 30 in the magazine 1 so that the arrows 30 are shot one by one. The user does not take a lot of time to pick another arrow to be loaded to the crossbow, because the arrows 30 in the storage space 11 of the magazine 1 are fed to the flight rail 20 one by one. Besides, the magazine 1 is easily mounted to the crossbow 10 by engaging the first engaging members 12 with the second engaging members 201.

As shown in FIGS. 2, 4, and 8 to 10, the magazine 1 includes a front section 13 and a rear section 14, and the two first engaging members 12 extend from the front section 13 of the magazine 1 and each have a groove 15. The two second engaging members 201 extend outward from the crossbow 10 and are slid into the grooves 15 of the two first engaging members 12. Therefore, the user simply sliding the magazine 1 toward the user to let the two second engaging members 201 engaged with the grooves 15 of the two first engaging members 12 to position the magazine 1 relative to the crossbow 10. Furthermore, the magazine 1 includes a slot 141 defined in the bottom thereof and the slot 141 is located corresponding to the rear section 14 of the magazine 1. The slot 141 opens to one end of the magazine 1 and facing the user. A rib 101 is formed to the top of the crossbow 10 and located corresponding to the slot 141 of the magazine 1. A trigger unit 40 is connected between the rib 101 and the flight rail 20. The trigger unit 40 includes a trigger that extends downward from the trigger unit 40 so that the user can pull the trigger to shoot the arrows 30. When installing the magazine 1 to the crossbow 10, the magazine 1 is slidably toward the user and move the slot 141 toward the rib 101 until the rib 101 of the crossbow 10 is engaged with the slot 141 of the magazine 1. The rib 101 and the trigger unit 40 are located in the slot 141 of the magazine 1. The slot 141 faces the user to ensure that the user does not install the magazine 1 in wrong direction.

The rear section 14 of the magazine 1 includes a first hole 142 defined transversely therethrough and communicates with the slot 141. The trigger unit 40 includes a second hole 401 that is located corresponding to and communicates with the first hole 142. A pin 5 extends through the first hole 142 and the second hole 401. The pin 5 includes a flange 51 and a shank 52 that extends from the flange 51. The flange 51 extends outward from one end of the pin 5. The flange 51 is located within the first hole 142 and the shank 52 extends beyond the second hole 401. The shank 52 includes a keyway 53 defined in the distal end thereof. When the user needs to remove the magazine 1 from the crossbow 10, the user simply pushes the keyway 53 toward the flange 51 to remove the pin 5 from the first and second holes 142, 401 by pushing the keyway 53 toward the flange 51. Similarly, when securing the magazine 1 to the crossbow 10, the user simply pushes the flange 51 toward the keyway 53 to extend the pin 5 through the first and second holes 142, 401.

In addition, the rear section 14 of the magazine 1 includes a third hole 143 defined transversely therethrough and communicates with the slot 141. The trigger unit 40 includes a dent 402 located corresponding to the third hole 143. A positioning member 6 extends through the third hole 143. When the magazine 1 is mounted to the flight rail 20 and the rib 101 is engaged with the slot 141, the positioning member 6 is engaged with the dent 402. This also prevent the user to install the magazine 1 in wrong direction.

Figure 3:
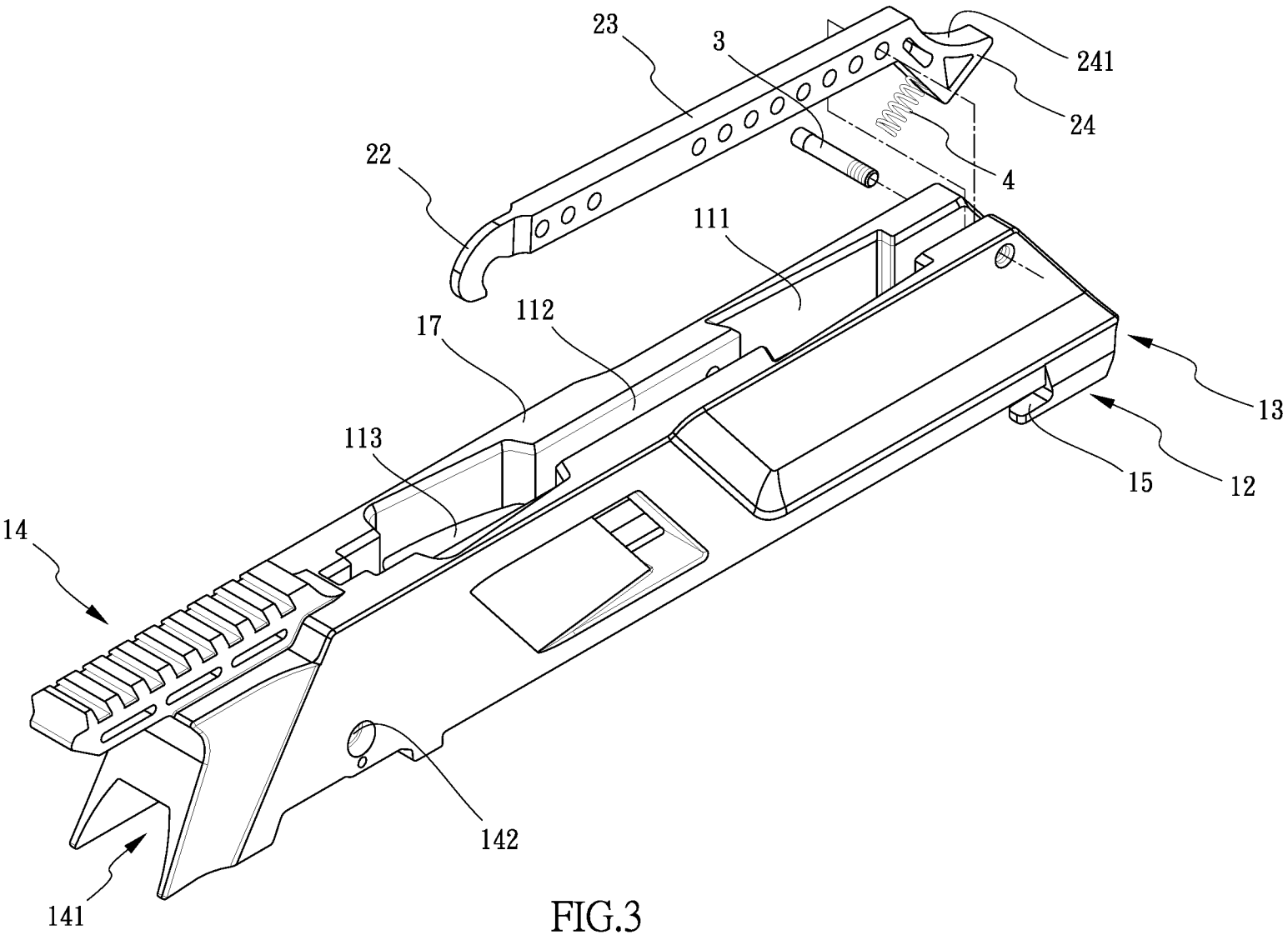
FIG. 3 is an exploded view to show the magazine and the retainer.
Figure 4:
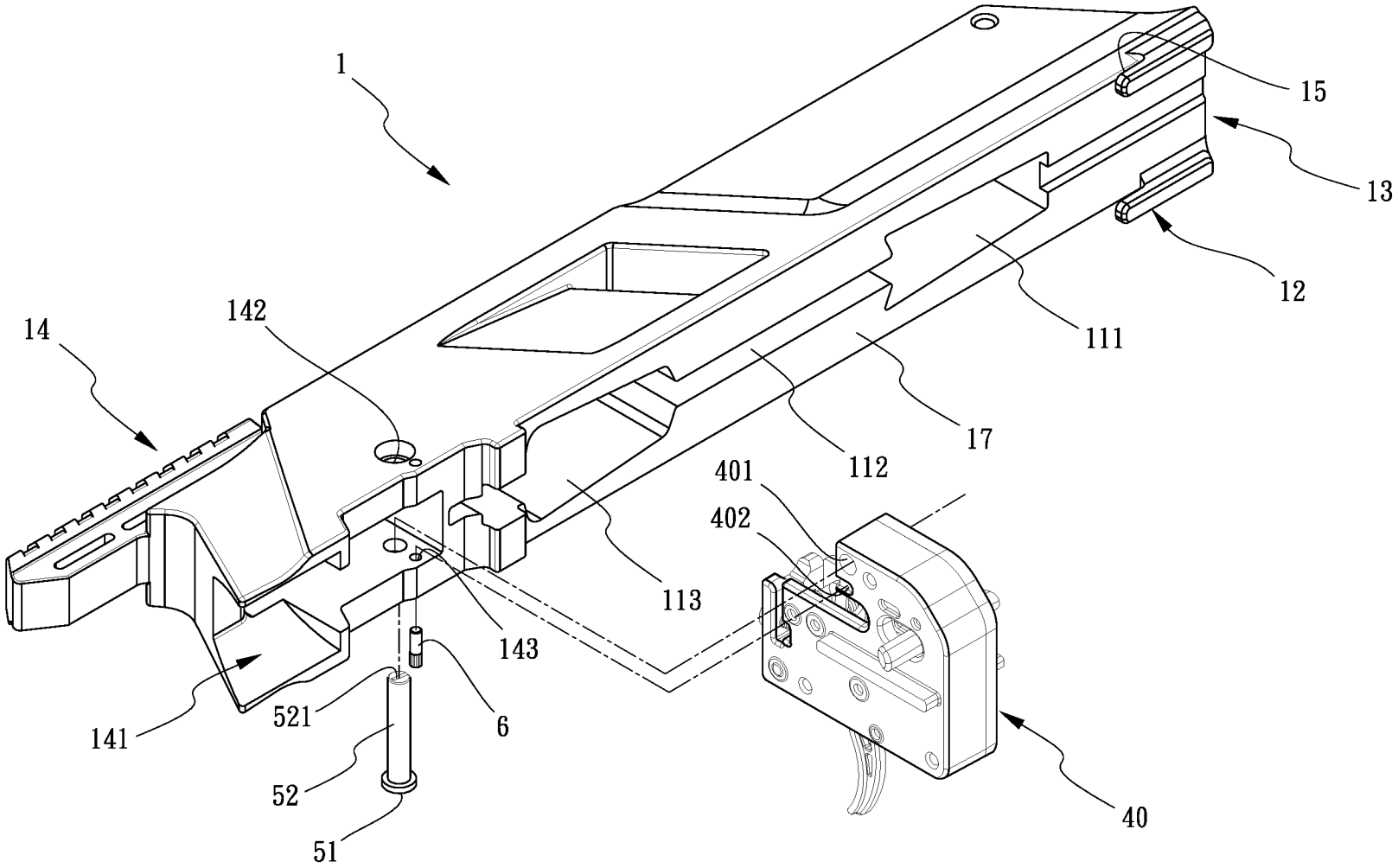
FIG. 4 is another exploded view to show the magazine and the retainer.
Figure 5:
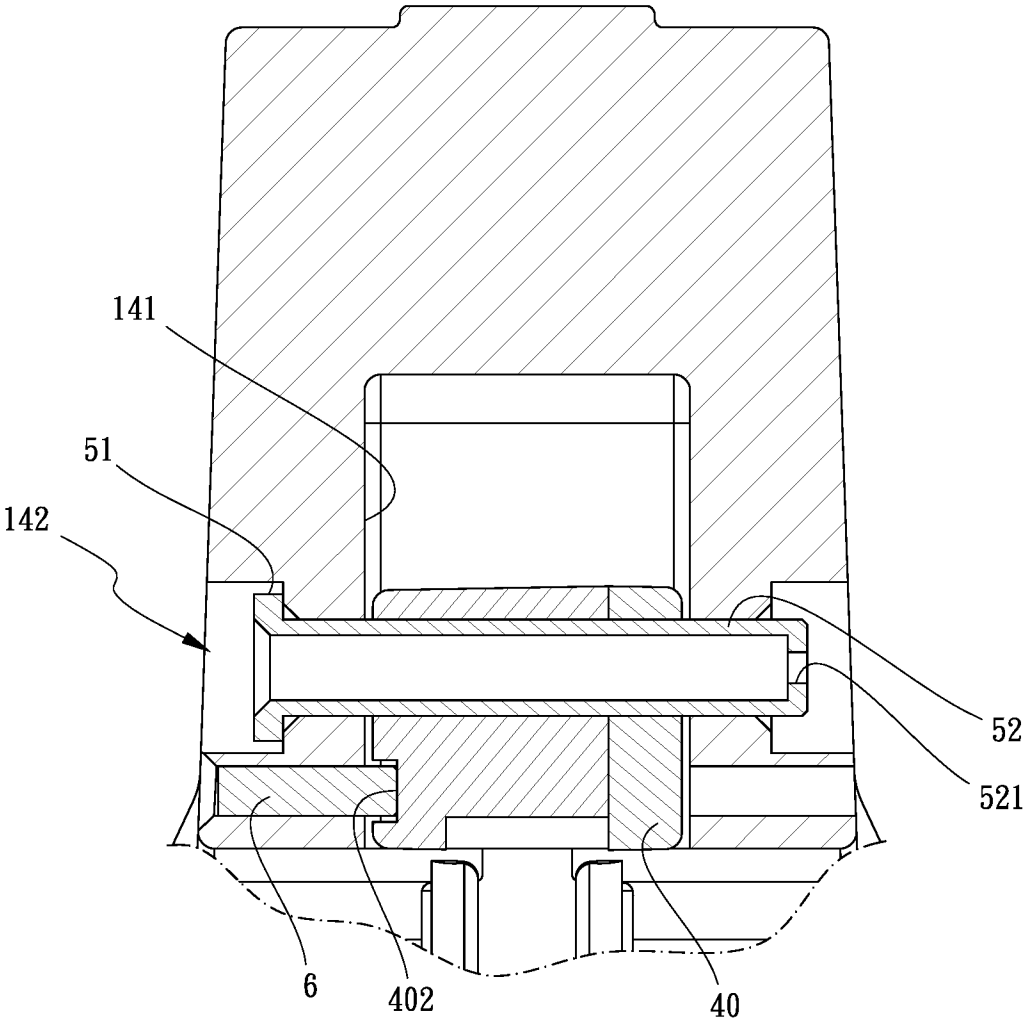
FIG. 5 is a cross sectional view, taken along line V-V in FIG. 1.
Figure 6:
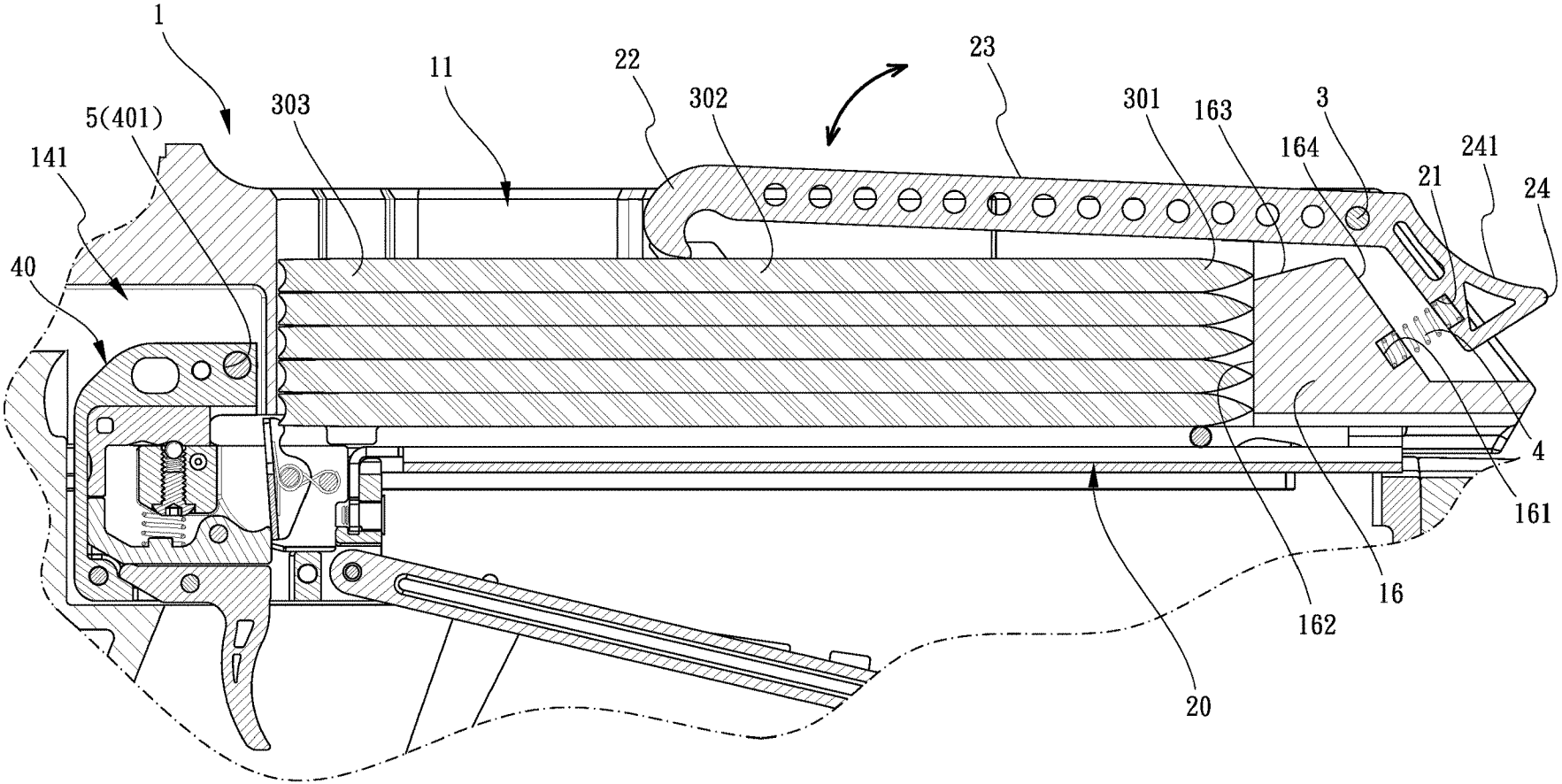
FIG. 6 is a cross sectional view, taken along line VI-VI in FIG. 1.
Figure 7:
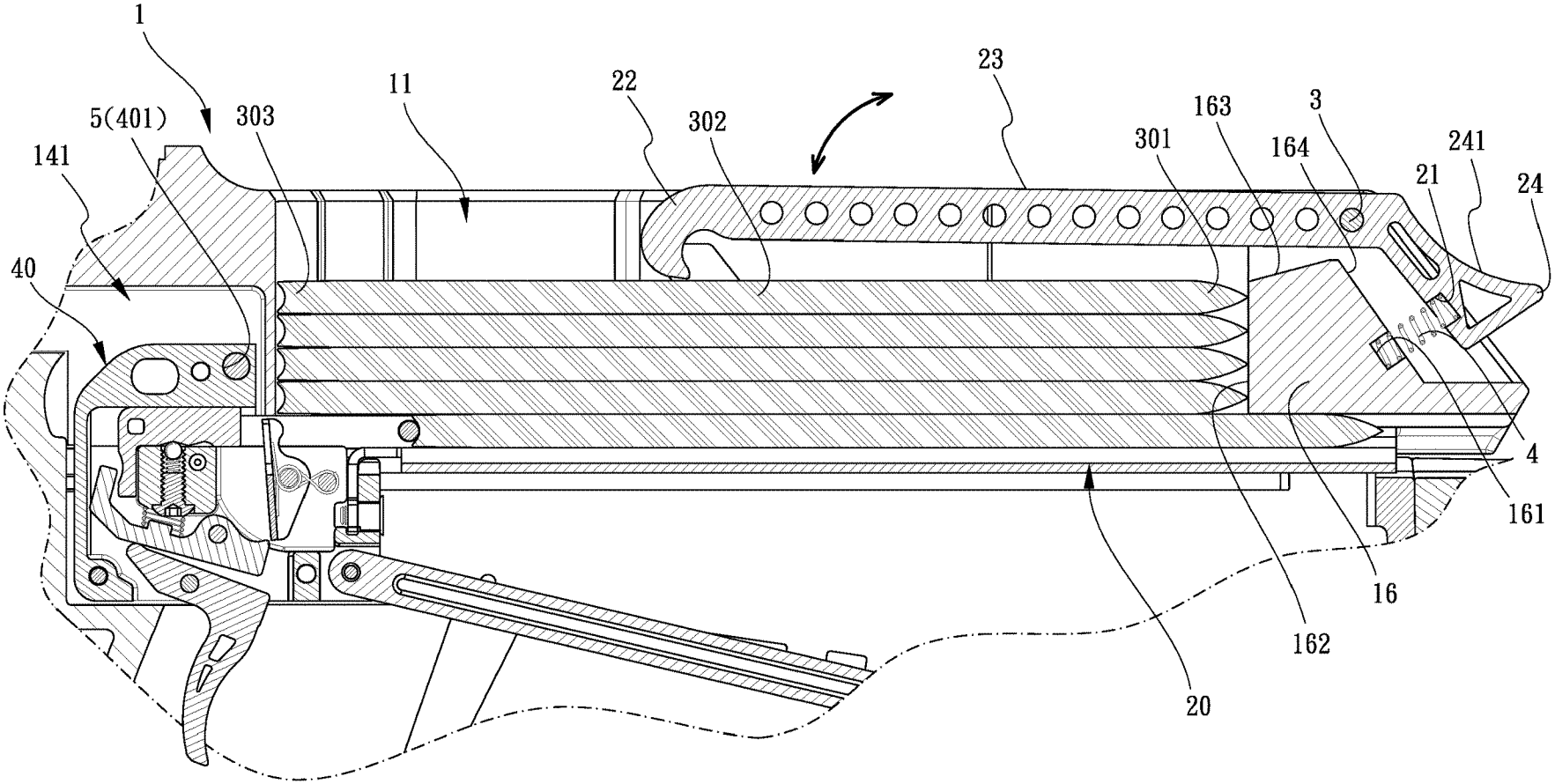
FIG. 7 is a cross sectional view to show that the retainer presses the arrows in the magazine, and the trigger unit is operated and the string pushes the lowest arrow.
Figure 8:
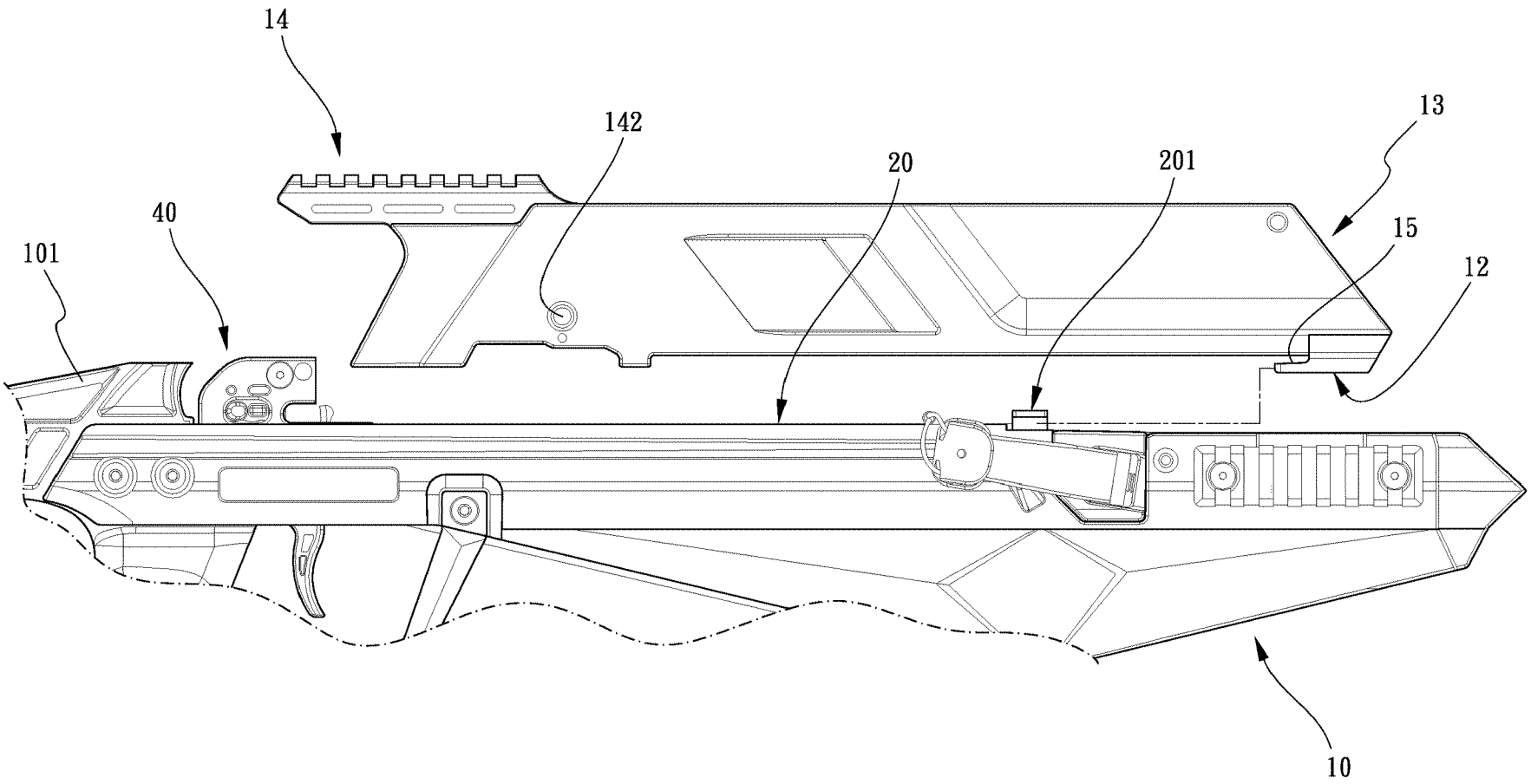
FIGS. 8 to 10 show how to install the magazine to the crossbow.
Figure 9:
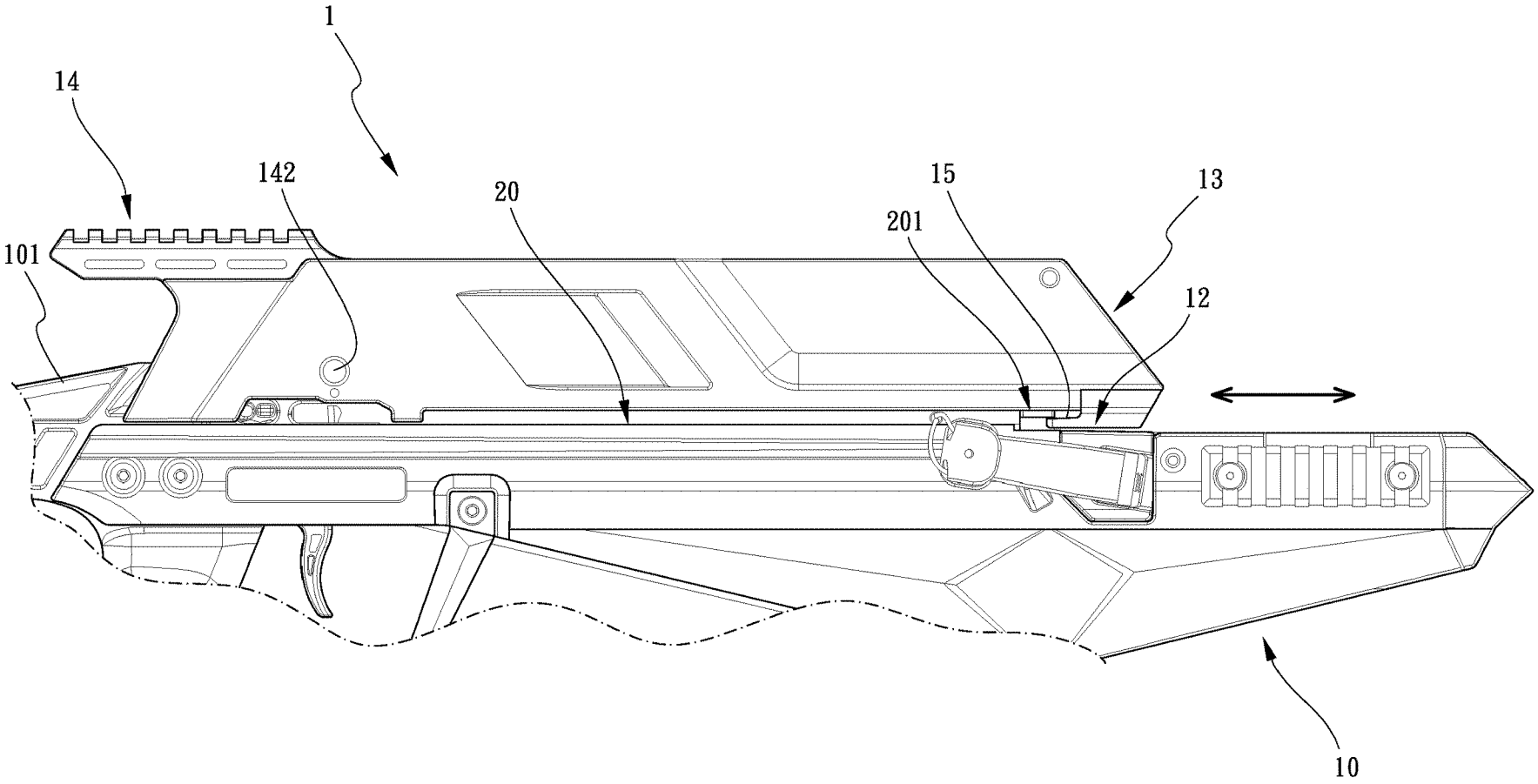
Figure 10:
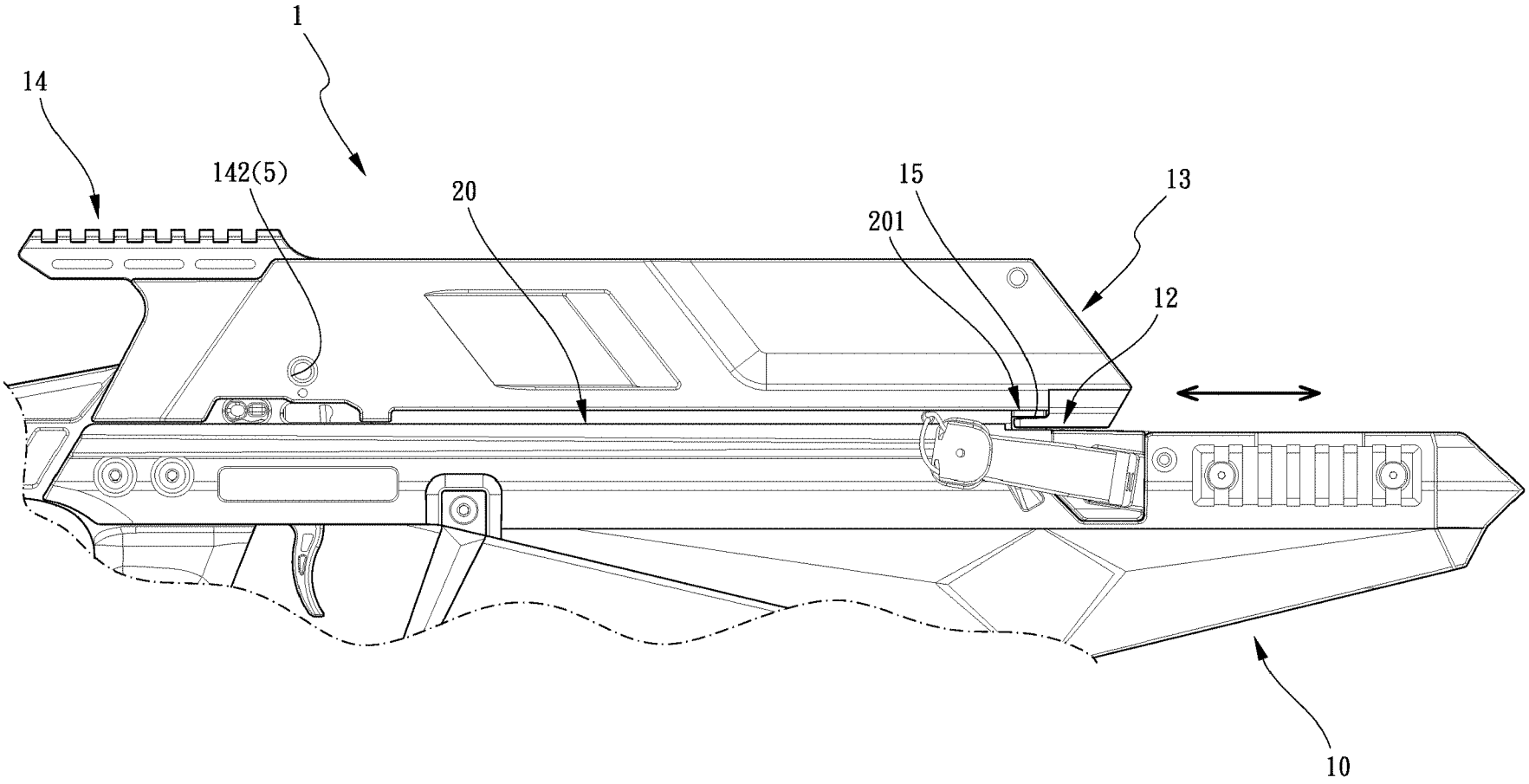

A block 16 is located in the storage space 11 and located corresponding to the first end of the retainer 2. The block 16 includes a first recess 161, and the retainer 2 includes a second recess 21. The two ends of the resilient member 4 are respectively engaged between the first and second recesses 161, 21 to ensure that the resilient member 4 is not shifted during operation. The block 16 includes a contact face 162, a top inclined face 163 and a front inclined face 164. The contact face 162 contacts the arrows 30 in the storage space 11 as shown in FIGS. 6 and 7. The top inclined face 163 extends from one end of the contact face 162 and extends upward and inclinedly. The front inclined face 164 extends from one end of the top inclined face 163 and extends downward toward the shooting direction. The first recess 161 is defined in the front inclined face 164. The retainer 2 approaches the top inclined face 163 along with the arrows 30 being shot as shown In FIGS. 3, 6 and 7.

The retainer includes a press end 22, an arm 23 and an end portion 24. The arm 23 is formed between the press end 22 and the end portion 24. The end portion 24 protrudes beyond the storage space 11. The resilient member 4 biases the end portion 24. The press end 22 includes a hook end which presses an upper most arrow 30. Besides, the end portion 24 includes a concave face 241 formed to the top thereof, and the concave face 241 is exposed beyond the storage space 11 so that the user uses his/her fingers to pivot the retainer 2 so that the press end 22 and the arm 23 are pivoted upward and extend beyond the storage space 11 such that the user can load arrows 30 in tot eh storage space 11 as shown In FIGS. 6 and 7.

Figure 11:
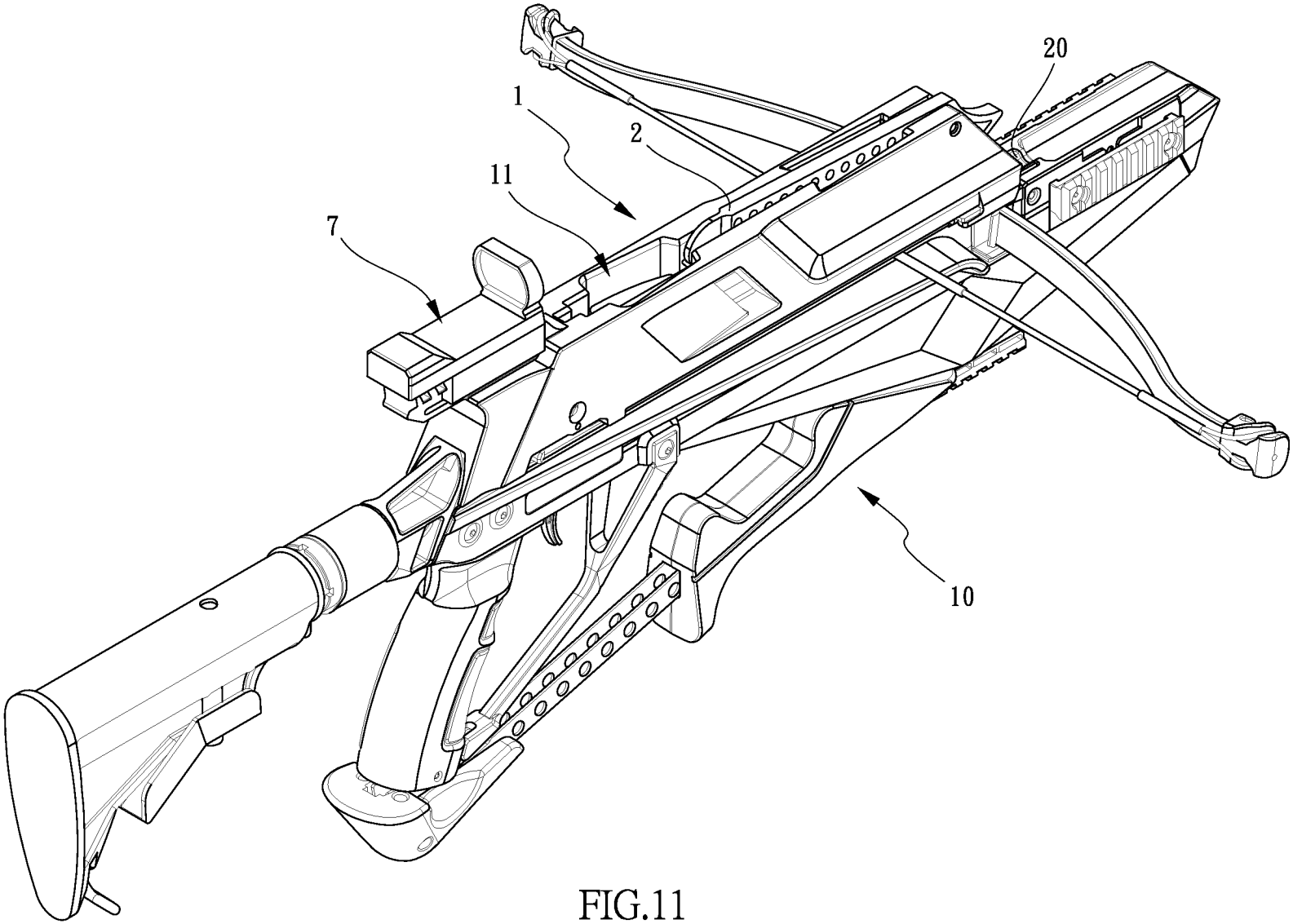
FIG. 11 shows that the magazine includes an aiming member connected to the top thereof.

The protrusions 17 divide the storage space 11 into a first section 111, a second section 112 and a third section 113. The second section 112 is located between the first section 111 and the third section 113. The first, second and third sections 111, 112, 113 communicate with each other. Each arrow 30 includes a head 301, a tail 303 and a shank 302 which is formed between the head 301 and the tail 303. The head 301 of the arrow 30 is located in the first section 111. The tail 303 of the arrow 30 is located in the third section 113. The shank 302 of the arrow 30 is located in the second section 112 and contacts two protrusions 17. By the first, second and third sections 111, 112, 113, the arrows 30 are ensured to be loaded in correct direction. The magazine 1 may include an aiming member 7 connected to the top thereof for better shooting precision as shown in FIG. 11.

While we have shown and described the embodiment in accordance with the present invention, it should be clear to those skilled in the art that further embodiments may be made without departing from the scope of the present invention.

What is claimed is:

1. A crossbow with an arrow feeding device, comprising:

a magazine mounted to a top of a crossbow and located above a flight rail of the crossbow, a storage space defined through the magazine from a top of the magazine to a bottom of the magazine, multiple arrows loaded in the storage space, two first engaging members formed to the bottom of the magazine, the storage space located between the two first engaging members, two second engaging members formed to the top of the crossbow, the flight rail located between the two second engaging members, two protrusion respectively extending inward from two inside walls of the storage space and contacting the arrows in the storage space, when the magazine is mounted to the top of the crossbow, the first engaging member are engaged with the second engaging members, and a retainer having a first end thereof located in the storage space and connected to the magazine, a bolt extending through the magazine and extending through the retainer from outside of the magazine to connect the retainer to the magazine, a resilient member located in the storage space and biased between the retainer and an inside of the storage space, the resilient member provides a force to make the retainer resiliently and normally press the arrows in the storage space, wherein the retainer includes a press end, an arm and an end portion, the arm is formed between the press end and the end portion, the end portion protrudes beyond the storage space, the resilient member biases the end portion, the press end includes a hook end which presses an upper most arrow.

2. The crossbow with an arrow feeding device as claimed in claim 1, wherein the magazine includes a front section and a rear section, the two first engaging members extend from the front section of the magazine and each have a groove, the two second engaging members extend outward from the crossbow and are slid into the grooves of the two first engaging members.

3. The crossbow with an arrow feeding device as claimed in claim 2, wherein the magazine includes a slot defined in the bottom thereof and the slot is located corresponding to the rear section of the magazine, a rib is formed to the top of the crossbow and located corresponding to the slot of the magazine, a trigger unit is connected between the rib and the flight rail, the magazine is slidably mounted to the top of the crossbow, and the rib of the crossbow is engaged with the slot of the magazine, the rib and the trigger unit are located in the slot of the magazine.

4. The crossbow with an arrow feeding device as claimed in claim 3, wherein the rear section of the magazine includes a first hole defined transversely therethrough and communicates with the slot, the trigger unit includes a second hole that is located corresponding to and communicates with the first hole, a pin extends through the first hole and the second hole, the pin includes a flange and a shank, the flange extends outward from one end of the pin, the flange is located within the first hole and the shank extends beyond the second hole, the shank includes a keyway defined in a distal end thereof, the pin is removed from the first and second holes by pushing the keyway toward the flange.

5. The crossbow with an arrow feeding device as claimed in claim 3, wherein the rear section of the magazine includes a third hole defined transversely therethrough and communicates with the slot, the trigger unit includes a dent located corresponding to the third hole, a positioning member extends through the third hole, when the magazine is mounted to the flight rail and the rib is engaged with the slot, the positioning member is engaged with the dent.

6. The crossbow with an arrow feeding device as claimed in claim 1, wherein a block is located in the storage space and located corresponding to the first end of the retainer, the block includes a first recess, the retainer includes a second recess, two ends of the resilient member are respectively engaged between the first and second recesses.

7. The crossbow with an arrow feeding device as claimed in claim 6, wherein the block includes a contact face, a top inclined face and a front inclined face, the contact face contacts the arrows in the storage space, the top inclined face extends from one end of the contact face and extends upward and inclinedly, the front inclined face extending from one end of the top inclined face and extends downward toward a shooting direction, the first recess is defined in the front inclined face, the retainer approaches the top inclined face along with the arrows being shot.

8. The crossbow with an arrow feeding device as claimed in claim 1, wherein the end portion includes a concave face formed to a top thereof, the concave face is exposed beyond the storage space.

9. The crossbow with an arrow feeding device as claimed in claim 1, wherein the protrusions divide the storage space into a first section, a second section and a third section, the second section is located between the first section and the third section, the first, second and third sections communicate with each other, each arrow includes a head, a tail and a shank which is formed between the head and the tail, the head of the arrow is located in the first section, the tail of the arrow is located in the third section, the shank of the arrow is located in the second section, the shank of the arrow contacts two protrusions.

* * * * *